United States Patent [19]

Bustos

[11] Patent Number: 4,896,385

[45] Date of Patent: Jan. 30, 1990

[54] BUNK BED FRAME

[75] Inventor: Rafael T. Bustos, Alpharetta, Ga.

[73] Assignee: Leggett & Platt, Inc., Carthage, Mo.

[21] Appl. No.: 236,655

[22] Filed: Aug. 25, 1988

[51] Int. Cl.[4] ..... A47C 19/20

[52] U.S. Cl. ..... 5/9 R; 5/9 B; D6/383

[58] Field of Search ..... 5/8, 9 R, 9 B; 105/316, 105/319; 114/192, 193; D6/393, 383

[56] References Cited

U.S. PATENT DOCUMENTS

| | | | |
|---|---|---|---|
| Re. 24,457 | 4/1958 | Hopeman, Jr. et al. . | |
| 33,924 | 12/1861 | Baker | 5/9 R X |
| D. 279,735 | 7/1985 | Anacker . | |
| 640,782 | 1/1900 | Lein . | |
| 895,898 | 8/1908 | Scheer . | |
| 2,839,765 | 6/1958 | Cogley . | |
| 2,953,792 | 9/1960 | Fleischer . | |
| 3,054,120 | 9/1962 | Fronsor, Jr. | 5/9 R |
| 3,647,267 | 8/1953 | McLaughlin | 5/9 R |
| 3,678,518 | 7/1922 | Litkewycz | 5/9 R |
| 3,886,604 | 7/1975 | Ewing | 5/9 R X |
| 4,051,564 | 10/1977 | Gudish . | |
| 4,193,146 | 3/1980 | Fredman et al. . | |

*Primary Examiner*—Michael F. Trettel

*Attorney, Agent, or Firm*—Wood, Herron & Evans

[57] ABSTRACT

A bunk bed frame of two rigid members has parallel spaced midportions for partially bounding an upper sleeping surface. Each midportion is connected to first and second end portions, the first end portions converging downwardly to an upper point of convergence along a mid plane between the midportions, further extending downwardly in secured juxtaposition to a lower point of convergence, diverging from the mid plane and further extending downwardly to contact the floor. The second end portions are mirror images of the respective first end portions. Below the lower points of convergence, a pair of spaced, horizontally disposed supports connect the first end portions to the respective second end portions of the members, thus partially bounding a lower sleeping surface.

14 Claims, 5 Drawing Sheets

BUNK BED FRAME

BACKGROUND OF THE INVENTION

A typical bunk bed frame provides at least two planar support surfaces in stacked arrangement and connected to two vertically upright frame members that are located at the head and foot ends of the bed. The support surfaces are usually connected to the frame members at the corners.

There are a number of inherent disadvantages associated with bunk bed structures of this type. The vertically oriented frame members located at the head and foot of the bed tend to box in the lower bunk, reducing access to the corners of a lower mattress when the bed is to be made. Moreover, a frame comprised of vertically upright members connected at the head and foot of the bed to horizontal support surfaces is susceptible to end-to-end sway or tilt when a horizontal force is directed against either of the vertical members.

It is an object of this invention to provide a bunk bed frame which is more stable than prior bunk beds, yet at the same time provides greater access to the lower bunk.

SUMMARY OF THE INVENTION

To these ends, a preferred embodiment of this invention provides a bunk bed frame comprising two metal tubes of circular cross section having mid portions extending horizontally in spaced disposition to partially bound an upper horizontal sleeping surface, first end portions extending downwardly in a first common vertical plane which corresponds to the head of the bed, and second end portions extending downwardly in a common vertical plane which corresponds to the foot of the bed. The first end portions converge downwardly to a first point of convergence along a mid plane between the mid portions and then extend further downwardly in secured juxtaposition to a second point of convergence whereupon the first end portions diverge from the mid plane and then extend further downwardly to contact the floor. The second end portions of the tubes are mirror images of the first end portions. The first end portions are connected to their respective second end portions below the second points of convergence by a pair of horizontally spaced supports which partially bound a lower horizontal sleeping surface. A welded grid of wires extends between the mid portions of the rigid tubes to support the upper sleeping surface, and a lower grid of welded wires extends between the horizontal supports to support the lower sleeping surface. The frame is further outfitted with guard rails partially bounding the upper horizontal sleeping surface. On one side of the bed, a ladder is removably supported by the mid portion above and the horizontal support below.

By connecting the two rigid tubular members in secured juxtaposition only along the mid plane, the bunk bed frame of this invention provides increased stability against end-to-end sway or tilt caused when a horizontal force is directed against the head or the foot of the bed. For the described structure, the application of such a force would more than likely cause the entire unitary frame to slide as one piece across the floor, as opposed to causing relative sway between the connected parts of a conventional bunk bed frame.

This inventive bunk bed frame also provides for easy assembly, the first end portion of the respective members and the second end portion of the members being easily secured in juxtaposition with threaded bolt and nut connections.

The juxtaposition of the first end portions at the head of the bed and the juxtaposition of the second end portions at the foot of the bed permit easy access to the corners of the bottom bunk to facilitate making the bed or sitting at the head or foot end of the bed. Moreover, the reduced width decreases the overall weight of the bed frame, resulting in lowered shipping costs.

These and other objects and advantages will be further appreciated in light of the detailed descriptions and drawings in which:

DETAILED DESCRIPTION OF THE DRAWINGS

Figure 1:
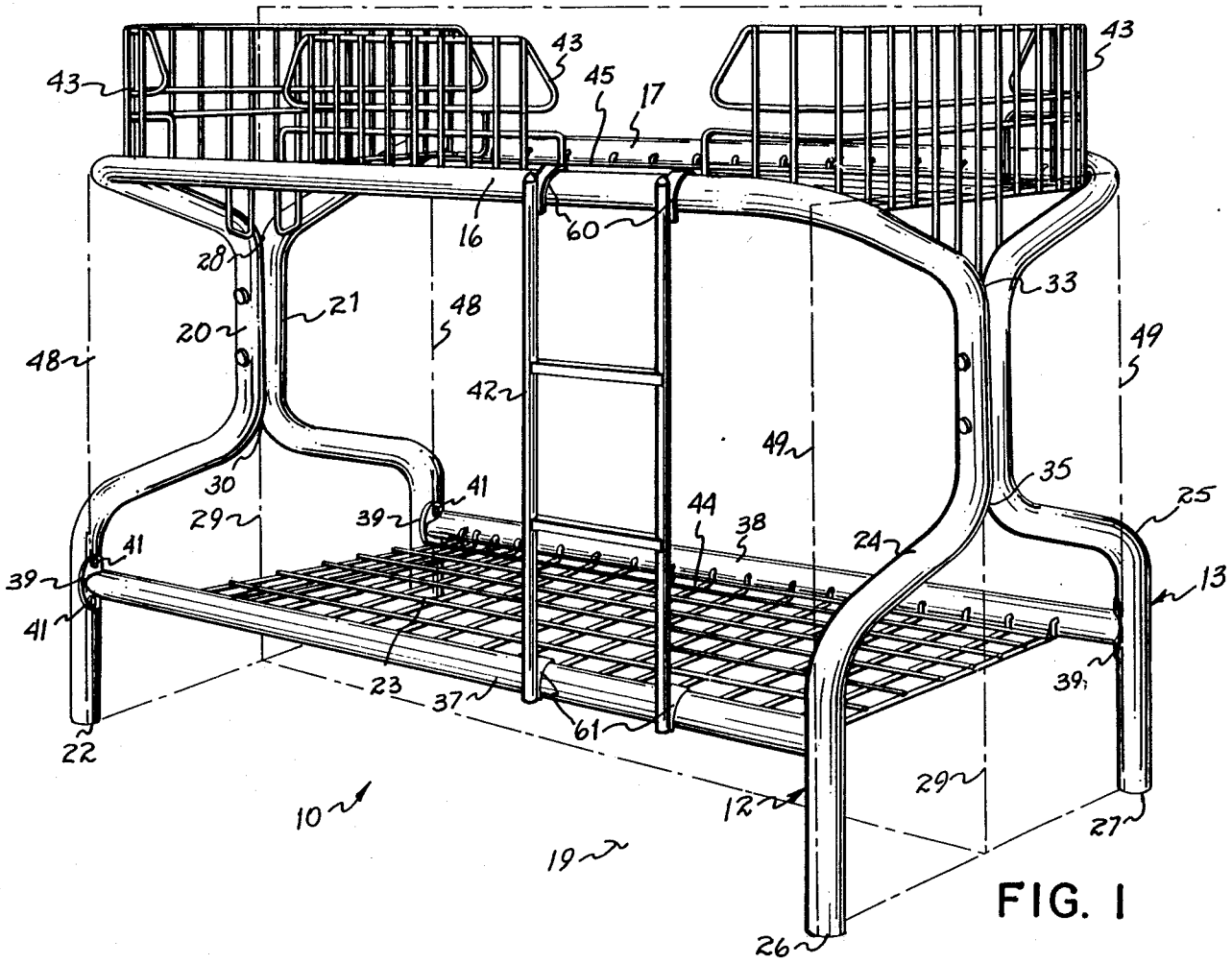
FIG. 1 is a perspective view of a bunk bed frame according to a first preferred embodiment of the invention.

FIG. 1 shows a bunk bed frame 10 according to a preferred embodiment of the invention. The frame 10 is ground supported by two rigid members, 12 and 13, which are preferably formed metal tubes of circular cross-section. The first and second rigid members 12 and 13 have horizontally extending, spaced mid portions 16 and 17, respectively, which partially bound an upper sleeping area. At a front end of the bed, horizontal midportions 16 and 17 are connected to first end portions, 20 and 21, respectively. At a second end of the bed, mid portions 16 and 17 are connected to second end portions 24 and 25, respectively. Alternatively, the midportions may be connected to the respective end portions by a sleeve connection, the sleeves providing substantially the same uniform rigidity as the unitary, one piece construction.

Figure 3:
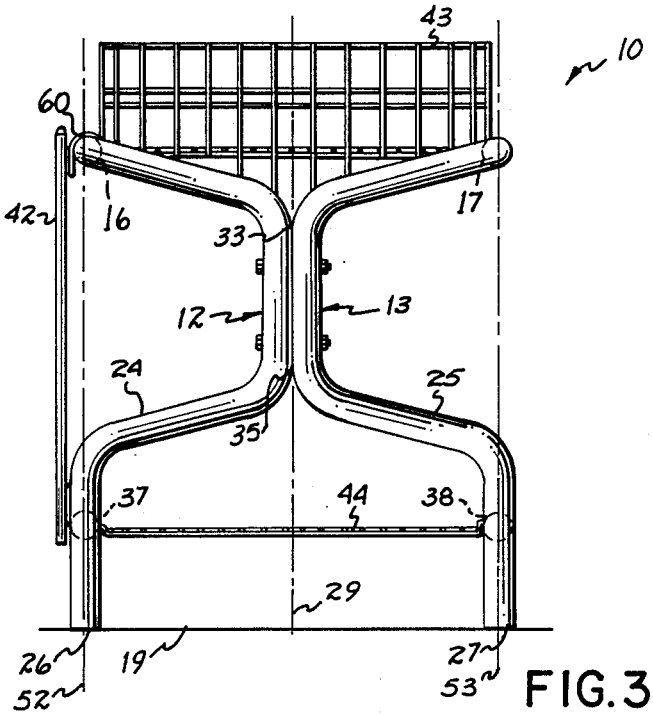
FIG. 3 is a side view of a preferred embodiment of the invention.
Figure 4:
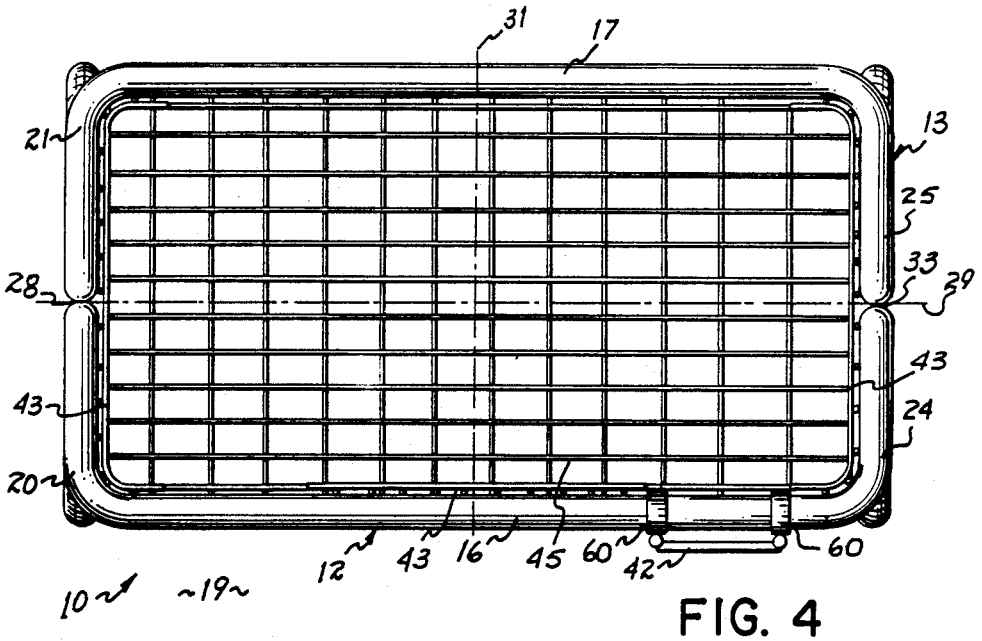
FIG. 4 is a plan view of the bunk bed frame shown in FIG. 1.

First end portions 20 and 21 converge downwardly from mid portions 16 and 17, respectively, toward an upper point of convergence 28 which lies on a mid plane 29 between the mid portions. The location of mid plane 29 is best shown in FIG. 3. From the upper point of convergence 28, first end portions 20 and 21 extend downwardly in secured juxtaposition to a lower point of convergence 30 on mid plane 29. From the lower point of convergence 30, first end portions 20 and 21 diverge from mid plane 29 and then extend downwardly to contact the floor, or supporting surface 19. Second end portions 24 and 25 are mirror images of the first end portions 20 and 21 with respect to mid plane 29, and with respect to a center plane 31 extending transversely across the bed. The second end portions converge to an upper point of convergence 33 and extend in secured juxtaposition to a lower point of convergence 35 before diverging downwardly to contact the ground 19.

The second points of convergence 30, 35 can be located approximately 18 inches above the supporting surface.

Below the second points of convergence 30 and 35, a pair of horizontally extending, spaced supports 37 and 38 connect first end portions 20 and 21 to second end portions 24 and 25, respectively. The horizontal supports partially bound a lower sleeping area. The ends of horizontal supports 37 and 38 have oval, arcuate flanges 39 with bores 40 machined therethrough for alignment with similarly spaced bores within the respective end portions. The bores 40 in the flanges 39 are aligned with the holes in the end portions and bolts 41 are extended therethrough to secure the supports in place (best shown in FIG. 6).

On one side of the bed, a ladder 42 extends from one of the mid portions above to a respective support below. Guard rails 43 extend upwardly around the periphery of the upper sleeping area, as a precautionary measure to prevent falling out of the bed. A welded wire grid 44 is detachably secured between horizontal supports 37 and 38 and adapted to support a lower mattress upon the bed frame. Similarly, another welded wire grid 45 extending across the upper sleeping surface is detachably secured to mid portions 16 and 17 to support an upper mattress.

Figure 5:
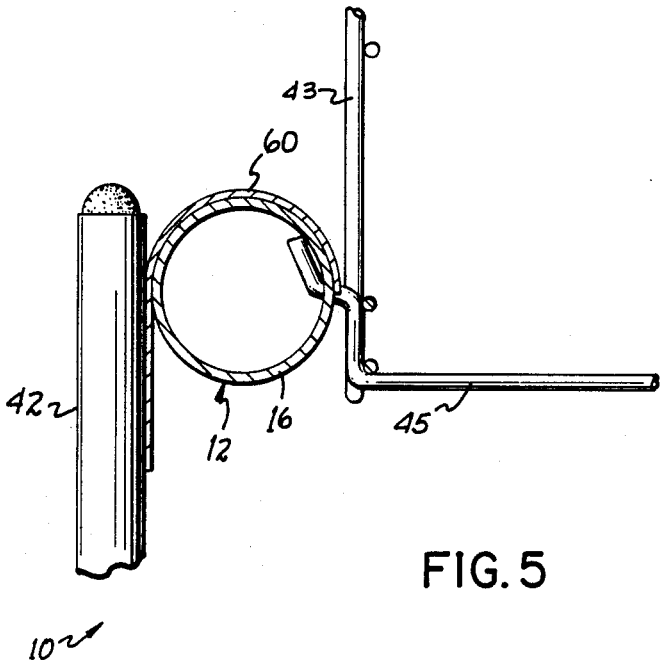
FIG. 5 is a cross-sectional view taken along lines 5—5 of FIG. 2 of a transversely directed wire extending from a welded grid of wires and connected to a mid portion or a horizontal support member according to a preferred embodiment of the invention.

According to a preferred manner of mounting the wire grids, mid portions and the supports have a plurality of uniformly spaced, inwardly directed, holes machined therein. The upper and lower wire grids are preferably formed from a plurality of evenly spaced longitudinally extending wires welded to a plurality of transversely extending wires. The ends of the transverse wires extend upwardly for insertion into the spaced holes and frictional engagement with an inner surface of the respective tube, as shown in FIG. 5.

Figure 2:
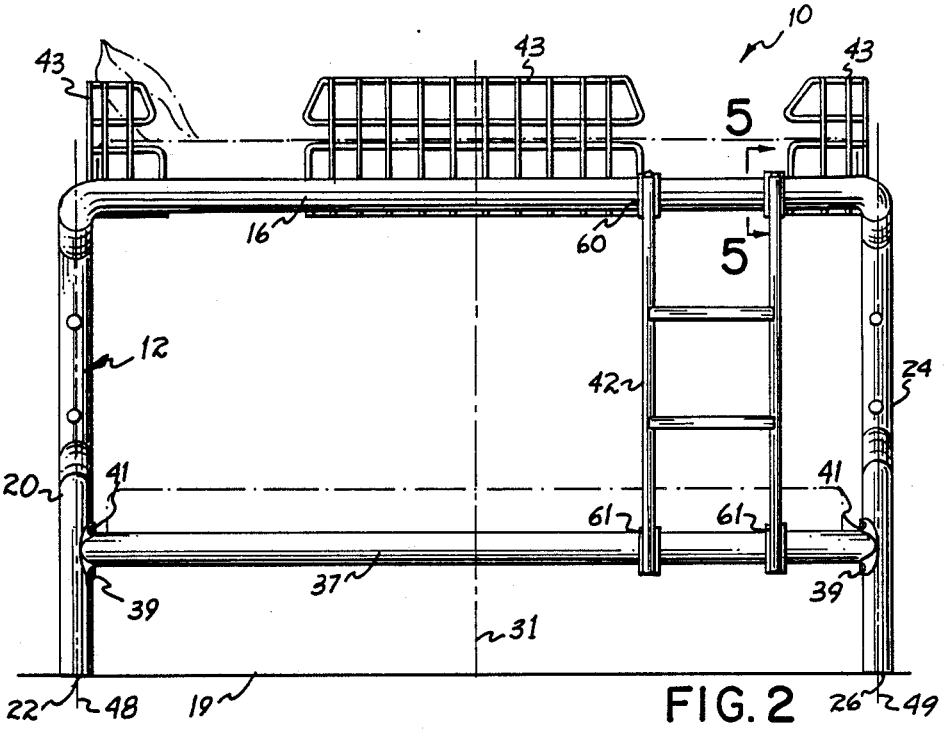
FIG. 2 is a front view of a preferred embodiment of the invention.

First end portions 20 and 21 and respective first ends 22 and 23 are aligned along a common vertical plane 48 which extends transversely at one end of the bed. Similarly, second end portions 24 and 25 and respective ends 26 and 27 are aligned along a common vertical plane 49 which extends transversely at another end of the bed. The distance between vertical plane 48 and vertical plane 49 equals the length of the bed frame, as shown in FIG. 2.

Mid portion 16 and horizontal support 37 lie along a common vertical plane 52 which extends longitudinally along one side of the bed. Similarly, mid portion 17 and support 38 lie along a common vertical plane 53 which extends longitudinally along the opposite side of the bed. The distance between longitudinal planes 52 and 53 corresponds to the width of the bed frame 10, as shown in FIG. 3.

Along vertical plane 48, first end portions 20 and 21 are preferably secured in juxtaposition by threaded bolts extending through aligned holes. The bolts are held in place by nuts. Similarly, along vertical plane 49, second end portions 24 and 25 are secured in juxtaposition by a threaded bolt and nut. Alternately, the first portions 20 and 21 may be secured in juxtaposition by welding and the second end portions 24 and 25 may also be secured in juxtaposition by welding.

Ladder 42 has a pair of upper hooks 60 welded adjacent the top of its uprights and a pair of lower hooks 61 welded adjacent the bottom of its legs for removable mounting to a side of the bed. The upper hooks 60 grasp one of the mid portions while the lower hooks 61 grasp a support below.

To assemble the bed frame, the horizontal supports are connected to tubular members 12 and 13. The upper and lower wire grids are then inserted into spaced holes on one side of the bed, the upper grid 45 being inserted into holes in one of the mid portions and the lower grid 44 being inserted into the holes in one of the supports. The opposite ends of the grids can then be inserted into the opposite holes by manipulating the unconnected member. With the grids in place, the end portions are connected along mid plane 29.

Figure 6:
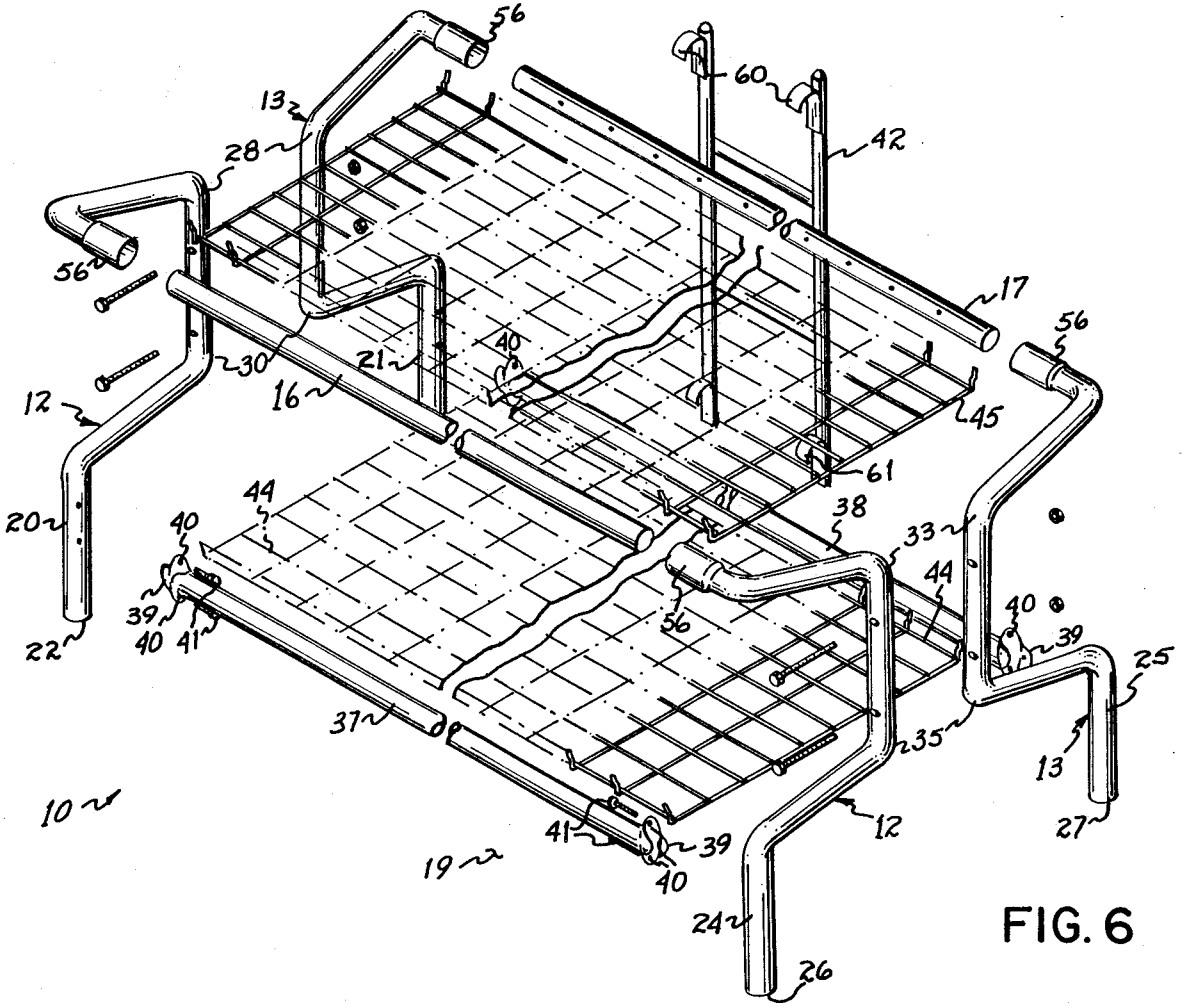
FIG. 6 is a perspective view of a disassembled bunk bed frame according to a second preferred embodiment of the invention.

FIG. 6 shows a disassembled view of a second preferred embodiment of the bunk bed frame 10 of this invention. According to this embodiment, members 12 and 13 are not formed as one unitary piece. The ends of mid portions 16 and 17 are telescopically received within collars 56 of the respective end portions 20, 21, 24 and 25. The mid portions 16 and 17 are maintained in place by an interference fit, or by welding if desired. This structure provides substantially the same rigidity as if members 12 and 13 were formed as single pieces.

Figure 7:
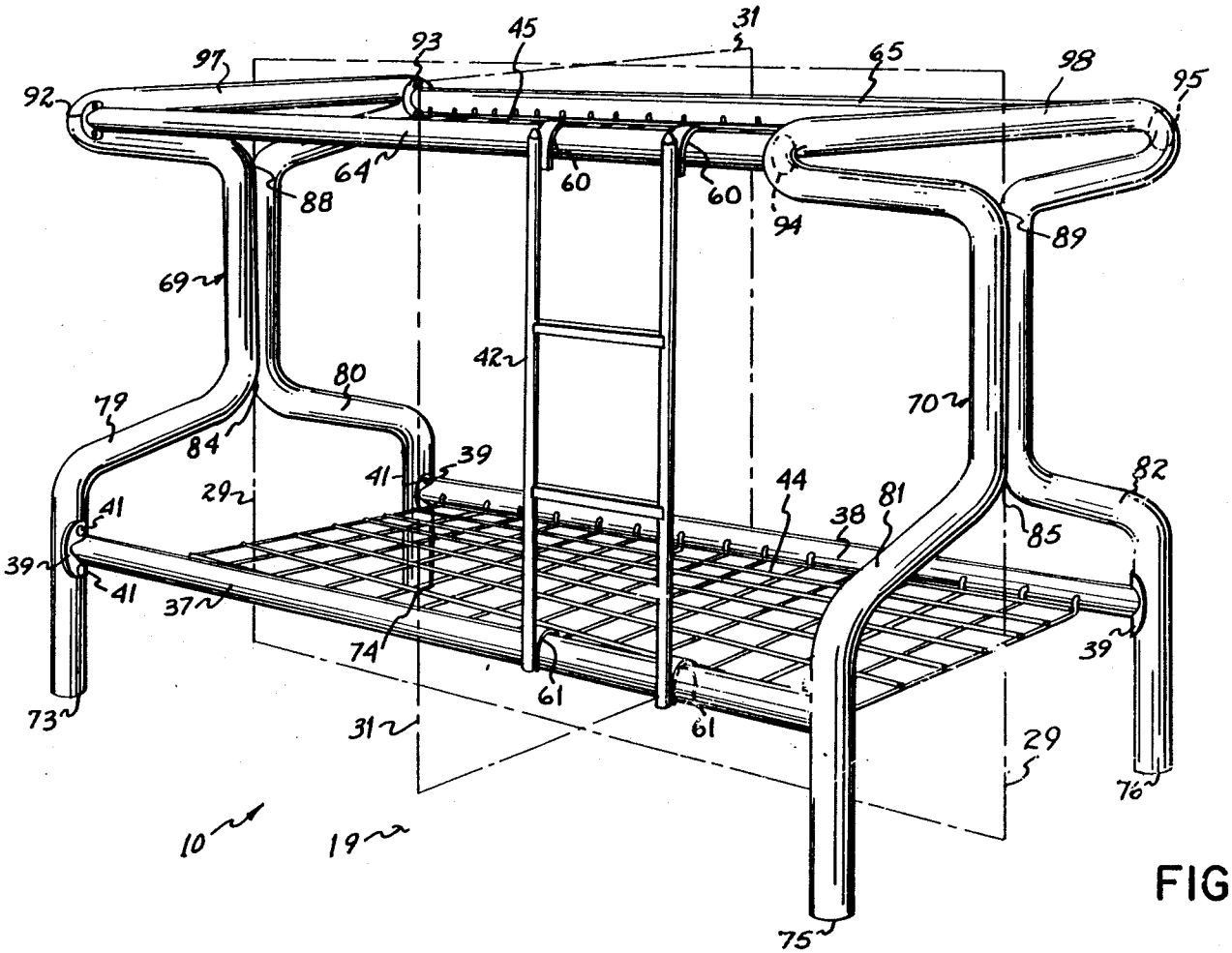
FIG. 7 is a perspective view of an alternate embodiment of the bunk bed frame of this invention.

FIG. 7 shows a bed frame according to an alternate embodiment of the invention. Instead of mid portions extending longitudinally in opposite sides of the upper bunk, the upper bunk is bounded by upper horizontally extended spaced supports 64 and 65. The upper spaced supports are removably connected to vertical supports 69 and 70 at the head and at the foot of the bed, respectively. The vertical supports are mirror images of each other with respect to transverse center plane 31 and mid plane 29. The vertical supports have spaced ground supported ends 73, 74, 75 and 76 and spaced portions 79, 80, 81 and 82 which extend upwardly from the ends and then converge to lower points of convergence 84 and 85 along mid plane 29.

From the lower points of convergence, the portions 79–82 extend upwardly in juxtaposition to upper points of convergence 88 and 89, whereupon the portions 79–82 diverge from mid plane 29 to provide spaced locations of connection 92, 93, 94 and 95 for the horizontal upper supports 64 and 65. Preferably, the vertical members 69 and 70 further include cross bars 97 and 98 which connect the spaced locations of connection 92 with 93 and 94 with 95, respectively. Preferably, each vertical support is molded as one unitary piece of metal tubing of circular cross section.

If desired, for either of the embodiments shown in FIG. 6 and FIG. 7 the juxtaposed portions at the respective ends of the bed can be welded between the upper and lower points of convergence. The embodiments of FIG. 6 and FIG. 7 provide a smaller package size for the bed frame, resulting in a savings in shipping costs. Use of welded connections between the top and bottom points of convergence at the ends of the bed does not necessitate an increase in package size. Even when welded in juxtaposition, the length and width dimensions of the vertical ends of the bed are smaller than the length and width dimensions of the wire grids. Thus, a package having sufficient length and width dimensions large enough to accommodate the wire grids will easily accommodate the length and width of the welded vertical supports.

While I have described two preferred embodiments of the bunk bed frame of this invention, and an alternate embodiment of the invention, it is to be understood that the invention is not limited thereby and that in light of the present disclosure of the invention, various other alternative embodiments will be apparent to a person skilled in the art. Accordingly, it is to be understood that changes may be made without departing from the scope of the invention as particularly set forth and claimed.

I claim:

1. A bunk bed frame comprising:

a pair of rigid members having spaced, horizontally disposed midportions and first and second end portions, said first and second end portions extending from opposite ends of said respective midportions, said first end portions converging to a first point of convergence on a mid plane between said midportions, said first end portions extending vertically in juxtaposition to a second point of convergence below said first point, said first end portions diverging from said second point of convergence and then extending vertically to contact a support surface, said first end portions being secured in juxtaposition between said first point and said second point;

said second end portions being mirror images of their respective first end portions with respect to said mid plane and a center plane extending transversely of the bed; and a pair of horizontally extending supports connecting said first end portions to said respective second end portions below said second points of convergence.

2. The bunk bed frame of claim 1 wherein said first end portions of said members converge to said mid plane and diverge from said mid plane in a common vertical plane extending transversely to the bed at a first end thereof; and said second end portions converge to said mid plane and diverge from said mid plane in a common vertical plane extending transversely to the bed at a second end thereof opposite said first end, the distance between said first and second vertical planes being equal to the length of the bed frame.

3. The bunk bed frame of claim 2 wherein said horizontally extending supports are aligned with said horizontally disposed midportions in vertical planes extending longitudinally along opposite sides of the bed, the transverse distance between said longitudinally extending vertical planes being equal to the width of the bed frame.

4. The bunk bed frame of claim 1 wherein said second point of convergence is located approximately 18 inches above said supporting surface.

5. The bunk bed frame of claim 1 wherein each said rigid member is an integrally formed, continuous piece.

6. The bunk bed frame of any one of claims 1, 2, 3, 4 or 5 wherein said rigid members and said horizontally extending supports are tubular.

7. The bunk bed frame of any one of claims 1, 2, 3, 4, or 5 wherein said rigid members and said horizontally extending supports are tubes having a circular cross-section.

8. The bunk bed frame of claim 1 wherein said midportions, said first end portions and said second end portions define a periphery which bounds an upper sleeping area, and further comprising:

guard rails extending upwardly from said periphery; and a ladder removably secured to a midportion and a horizontal support along a side of the bed.

9. The bed frame of any one of claims 1, 2, 3, 4, 5 or 8, and further comprising an upper grid of wires extending between and connected to said midportions of said pair of rigid members, and a lower grid of wires extending between and connected to said pair of horizontally extending supports, said first grid being adapted to support an upper mattress upon said bed frame and said second grid of wires being adapted to support a lower mattress upon said bed frame.

10. A bunk bed frame comprising:

an elongated first member having first and second spaced end portions and ends on each of said end portions, said first member being ground-supported at said ends in a first vertical plane extending longitudinally of the bed, each of said end portions extending vertically upwardly and then converging toward a second vertical plane extending longitudinally of the bed and spaced from said first vertical plane, said end portions extending further vertically upwardly in said second vertical plane for a selected distance and then diverging outwardly and away from said second vertical plane toward said first vertical plane, said end portions of said first member being connected in said first vertical plane by a horizontally disposed midportion, said end portions being further connected in said first vertical plane by a horizontally disposed support member, said mid portion being above said support member; and an elongated second member being a mirror image of said first member with respect to said second vertical plane, said second member having first and second spaced end portions and ground supported ends in a third vertical plane extending longitudinally of the bed, said third and said first vertical planes being equidistant from said second vertical plane, said first and second members being secured in juxtaposition in said second vertical plane, said midportions partially bounding an upper sleeping area and said horizontal support members partially bounding a lower sleeping area.

11. A frame for a bunk bed comprising:

two tubes of circular cross section for supporting and partially defining upper and lower sleeping surfaces of a bunk bed, each of said tubes having first and second spaced end portions, each of said first end portions having a ground-supported first end residing in a first transverse vertical plane corresponding to the head of the bed frame and a ground-supported second end residing in a second transverse vertical plane corresponding to the foot of the bed frame;

said first end portions extending upwardly from said ground supported first ends in said first vertical plane and then converging toward a lower point of convergence lying in a vertical mid plane directed longitudinally of the bed between said tubes, said first end portions extending further upwardly in secured juxtaposition from said lower point of convergence to an upper point of convergence, said first end portions then extending upwardly in said first transverse vertical plane while diverging away from said mid plane;

a pair of parallel, spaced midportions for connecting said first end portions of said tubes to the respective second end portions, said midportions extending from said first transverse vertical plane to said second transverse vertical plane, said second end portions of said tubes being mirror images of said first end portions with respect to said mid plane and a center plane extending transversely of the bed halfway between the head and the foot of the bed; and a pair of horizontally disposed supports connecting said first end portions of said tubes to their respective second end portions below said lower points of convergence, said supports being parallel to the respective midportions thereabove.

12. The bunk bed frame of claim 11 wherein each of said tubes is formed as one continuous piece.

13. A bed frame comprising:

a first vertical support having a pair of first portions with spaced ground supported first ends located in a first common vertical plane, said first common vertical plane extending transversely at one end of the bed, said portions extending upwardly and then converging to a lower point of convergence along a vertical mid plane extending longitudinally of the bed between said ground supported first ends, said first portions further extending upwardly in juxtaposition along said mid plane to an upper point of convergence, said first portions diverging upwardly from said upper point of convergence to first locations of connection spaced equidistant from said mid plane;

a second vertical support identical to said first vertical support but spaced therefrom, said second vertical support having a pair of second portions with spaced ground supported second ends located in a second common vertical plane, said second common vertical plane extending transversely to the bed frame at an end opposite said first vertical plane;

a pair of upper parallel members spaced equidistant from said mid plane and extending horizontally on opposite sides of said mid plane to connect said first vertical support to said second vertical support at said spaced locations of connection; and a pair of lower parallel members spaced equidistant from said mid plane and extending horizontally on opposite sides of said mid plane to connect said first vertical support to said second vertical support below said first points of convergence.

14. The bunk bed frame of claim 13 wherein each of said vertical supports further comprises:

a horizontally disposed crossbar connecting said spaced locations of connection to form one unitary support at an end of the bed frame; and said upper and lower pairs of parallel members being detachably secured to said vertical supports.

* * * * *